US007735602B2

(12) United States Patent
Yasuda et al.

(10) Patent No.: US 7,735,602 B2
(45) Date of Patent: Jun. 15, 2010

(54) MUFFLER STRUCTURE

(75) Inventors: Kazuhiro Yasuda, Saitama (JP); Tadashi Oshima, Saitama (JP); Koichi Tanaka, Saitama (JP); Kazuo Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 304 days.

(21) Appl. No.: 11/802,868

(22) Filed: May 25, 2007

(65) Prior Publication Data

US 2008/0000718 A1 Jan. 3, 2008

(30) Foreign Application Priority Data

May 30, 2006 (JP) ..... 2006-149514

(51) Int. Cl.
*F01N 13/08* (2010.01)

(52) U.S. Cl. ..... 181/227; 181/228; 181/252; 181/256; 181/212; 60/299

(58) Field of Classification Search ..... 181/256, 181/252, 227, 228; 60/299
See application file for complete search history.

(56) References Cited

U.S. PATENT DOCUMENTS 3,354,986 A * 11/1967 Griffin et al. ..... 181/269
3,752,260 A * 8/1973 Heath ..... 181/228
4,589,515 A * 5/1986 Omura ..... 181/227
5,873,710 A * 2/1999 Tucker ..... 417/410.5
6,941,751 B2 * 9/2005 Yamamoto et al. ..... 60/322

FOREIGN PATENT DOCUMENTS

FR 2695430 A1 * 3/1994
JP 2006-70705 A 3/2006

* cited by examiner

*Primary Examiner*—Jeffrey Donels
*Assistant Examiner*—Forrest M Phillips
(74) *Attorney, Agent, or Firm*—Birch, Stewart, Kolasch & Birch, LLP

(57) ABSTRACT

A muffler structure capable of suppressing generation of abnormal noise in the muffler even when the outer and the inner tubes expand thermally. Provided is a double-pipe muffler structure including an inner tube and an outer tube. In the muffler structure, an annular front step portion and an annular rear step portion are formed in the inner tube, while the step portions is brought into contact, from inside, with the outer tube and thus are supported by the outer tube. The outer tube supports the front and the rear step portions by being brought into close contact with the step portions partially and elastically.

8 Claims, 4 Drawing Sheets

MUFFLER STRUCTURE

CROSS-REFERENCE TO RELATED APPLICATION

The present application claims priority under 35 U.S.C. §119 to Japanese Patent Application No. 2006-149514, filed May 30, 2006, the entire contents of which are hereby incorporated by reference.

BACKGROUND OF THE INVENTION

1. Field of the Invention

The present invention relates to a muffler structure for damping the exhaust noise from an engine of a vehicle or the like.

2. Description of Background Art

A conventionally known type of muffler has a double-pipe structure, and the type of muffler includes an inner tube and an outer tube (see, for example, Japanese Patent Application Laid-Open No. 2006-070705). An annular step portion is formed in each of the front- and the rear-end portions of the inner tube, while each annular step portion is brought into contact with, all along its circumference, the outer tube from inside. One of the front and the rear step portions is fixed to the outer tube, while the other one of the step portions is allowed to slide relative to the outer tube. With this structure, the muffler can cope with the difference in thermal expansion between the inner tube and the outer tube.

In the above-mentioned muffler structure, the inner tube, which has the front and the rear step portions, is formed to be more rigid than the outer tube. The two tubes are supposed to be brought into close contact with each other. For this purpose, when the inner tube is inserted into the outer tube, the cross-sectional shape of the outer tube is deformed to fit to the cross-sectional shape of the inner tube. In an outer tube with a perfectly circular shape, the cross-sectional shape is hard to deform to expand. While the inner tube and the outer tube are supposed to be brought into close contact with each other, there may sometimes be a gap that are unintentionally created between these two tubes because of the above and other causes. In addition, a difference in thermal expansion between the inner tube and the outer tube may sometimes create a gap, though unintentionally, even between the two tubes both of which are allowed to slide relatively to each other. When such a gap is created, the gap causes abnormal noise to be generated in the muffler.

Under the above circumstances, the present invention provides a muffler structure capable of suppressing the generation of abnormal noise in the muffler even when the outer and the inner tubes expand thermally.

SUMMARY AND OBJECTS OF THE INVENTION

For the purpose of solving the problems described above, a first aspect of the present invention provides a structure of a muffler (for example, mufflers 10, 110 and 210 in the following embodiments) with the following characteristics. The muffler has a double-pipe muffler structure with an inner tube and an outer tube (for example, inner tubes 22, 122 and 222, and outer tubes 21, 121 and 221 in the following embodiments). The inner tube has an annular step portion which is brought into contact with the outer tube from inside, and which is supported by the outer tube. In the muffler structure, the outer tube is brought into close contact with the step portion partially and elastically to support the step portion.

A second aspect of the present invention provides the muffler structure with additional characteristics such that the outer tube supports the step portion at two or more contact portions (for example, contact portions 23*a*, 123*a* and 223*a*).

A third aspect of the present invention provides the muffler structure with the following additional characteristics. The outer tube includes a mounting member (for example, a mounting member 18) with which the outer tube is attached to a designated frame (for example, a body frame F in the embodiment), and which is provided between two adjacent ones of the contact portions.

A fourth aspect of the present invention provides the muffler structure with additional characteristics such that the outer tube has a cross-sectional shape that is different from the cross-sectional shape of the step portion of the inner tube.

A fifth aspect of the present invention provides the muffler structure with additional characteristics such that the outer tube and the inner tube are assembled together by deforming the cross-sectional shape of the outer tube to fit the cross-sectional shape of the step portion of the inner tube.

A sixth aspect of the present invention provides the muffler structure with additional characteristics such that the cross-sectional shape of the outer tube and the cross-sectional shape of the step portion of the inner tube are made to be different from each other when the two tubes are assembled together.

Effects of the Invention include the following:

In the first aspect of the present invention, the outer tube is, partially and elastically, brought into close contact with the inner tube that has a relatively high rigidity because the inner tube has the annular step portion. Accordingly, the inner tube can be supported with the tensile force (elastic resilience) of the outer tube. Thus, even with a difference in thermal expansion between the inner tube and the outer tube, no such gap will be formed between the step portion and the outer tube as the one formed all along the circumference, or no such thing will take place as a positional change of the gap between the step portion and the outer tube. As a result, generation of abnormal noise can be suppressed.

According to the second aspect of the present invention, the inner tube is securely supported by gripping the step portion with the tensile force of the outer tube.

In the third aspect of the present invention, when the muffler is attached to the frame, the weight of the muffler acts on itself. Thus, a larger tensile force of the contact portions adjacent to each other acts on the inner tube. As a result, the inner tube can be supported more securely.

In the fourth, fifth and sixth aspects of the present invention, the cross-sectional shape of the outer tube and the cross-sectional shape of the step portion of the inner tube are made different from each other before the two tubes are assembled together. The two tubes are assembled together while the outer tube is deformed to fit the inner tube. Also at the time when the two tubes are assembled together, the cross-sectional shape of the outer tube is made different from the cross-sectional shape of the step portion of the inner tube. Accordingly, the inner tube can be supported by bringing the outer tube into close contact with the inner tube partially and elastically. As a result, even when the inner tube and the outer tube thermally expand, the generation of abnormal noise in the muffler can be suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2(*a*) is the cross-sectional view of an outer tube in a separated state; FIG. 2(*b*) is the cross-sectional view of an inner tube in a separated state; and FIG. 2(*c*) is the cross-sectional view showing the state in which the inner tube is inserted into the outer tube;

DETAILED DESCRIPTION OF THE PREFERRED EMBODIMENTS

Figure 1:
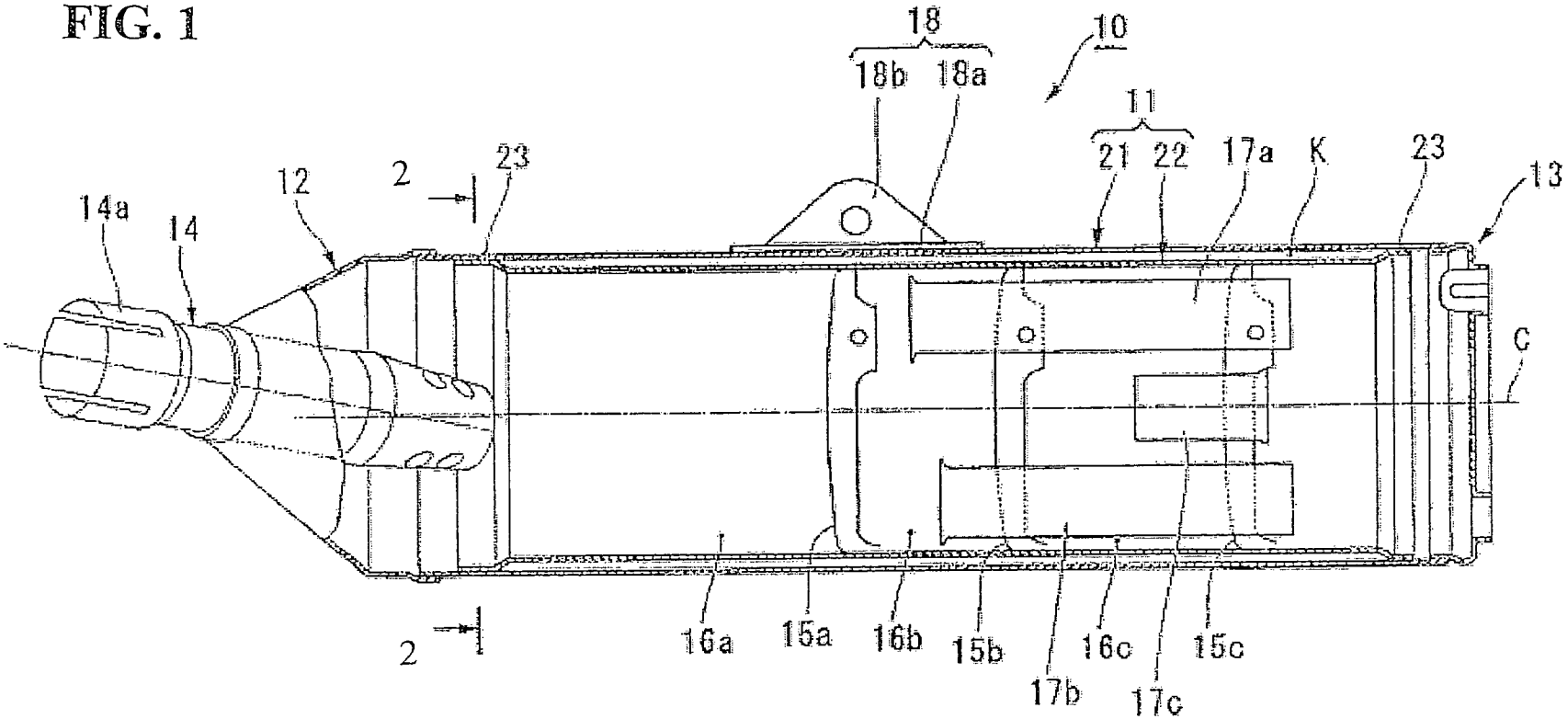
FIG. 1 is a side view of a muffler in an embodiment of the present invention.
Figure 2C:
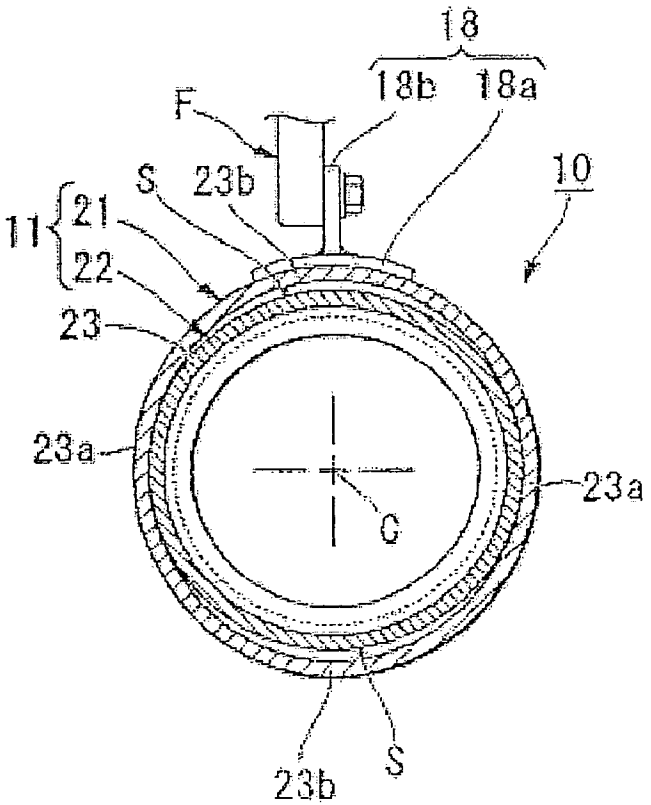
FIGS. 2(*a*) to 2(*c*) are cross-sectional views taken along the line 2-2 in FIG. 1.
Figure 2B:
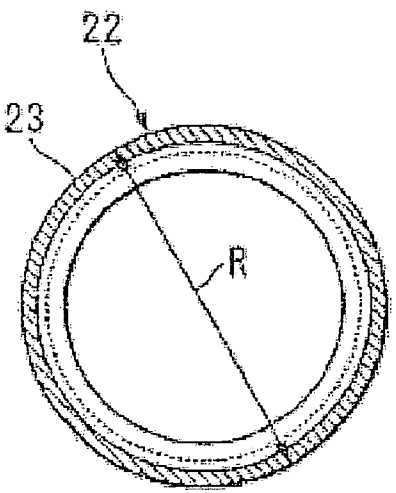
Figure 2A:
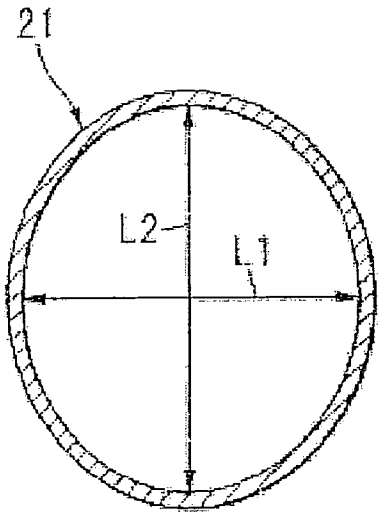
Figure 3C:
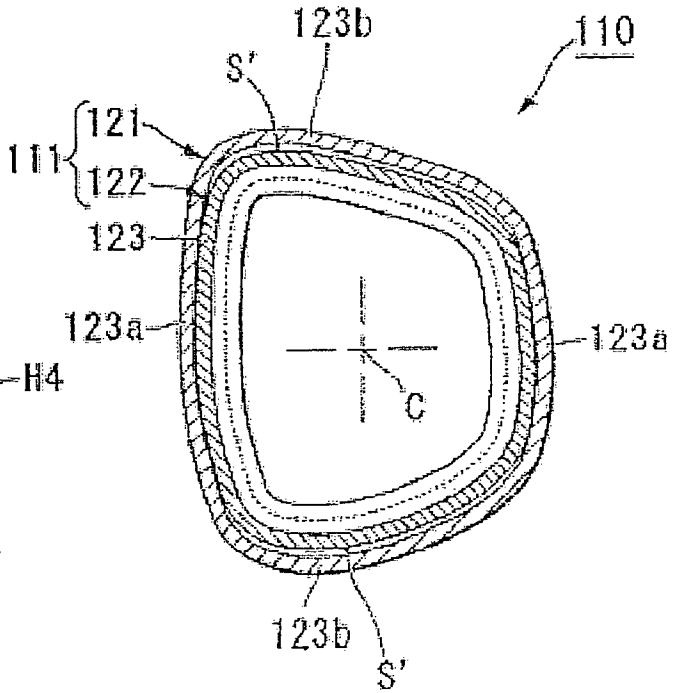
FIGS. 3(*a*) to 3(*c*) are cross-sectional views respectively corresponding to FIGS. 2(*a*) to 2(*b*) but for a second embodiment.
Figure 3B:
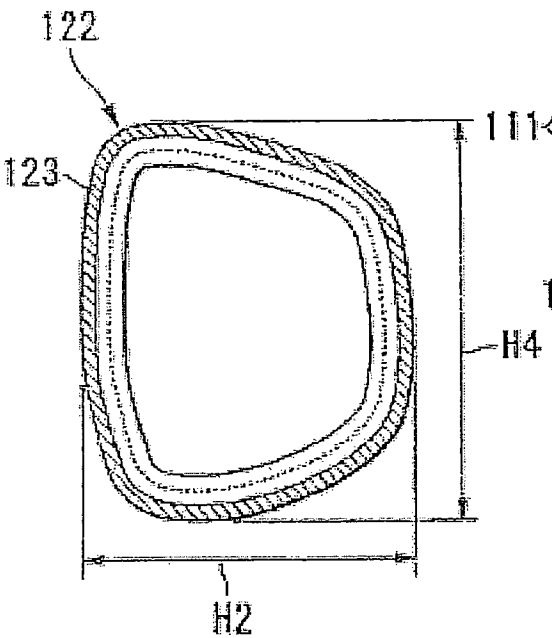
Figure 3A:
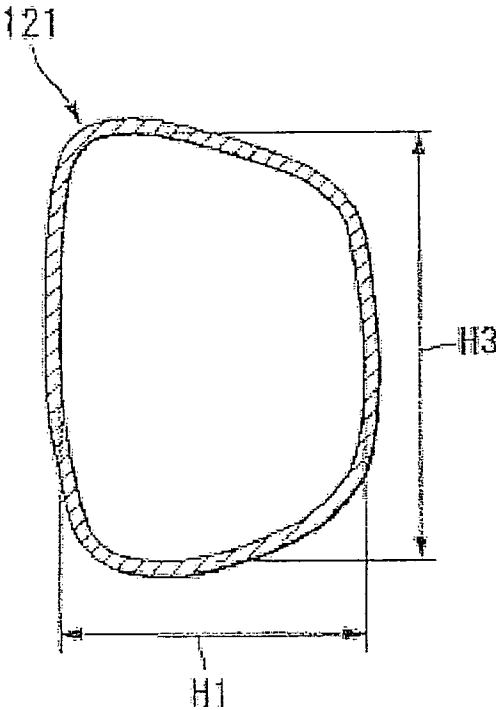
Figure 4C:
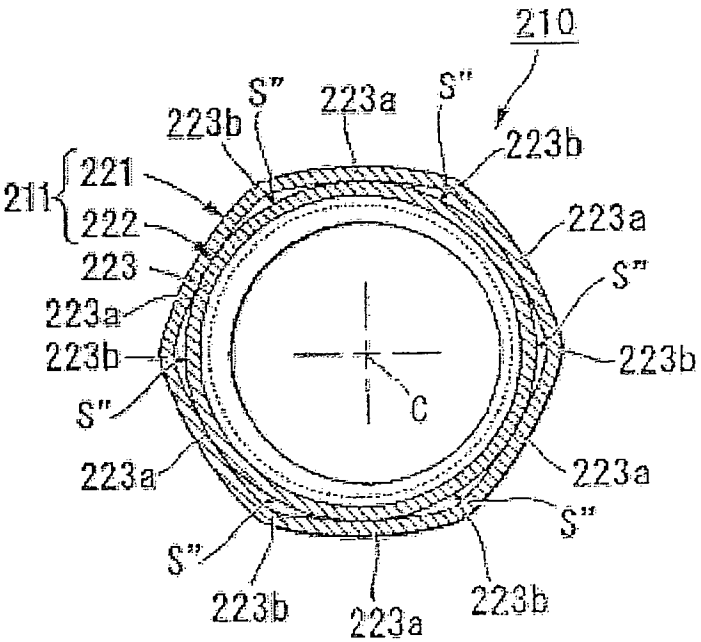
FIGS. 4(*a*) to 4(*c*) are cross-sectional views respectively corresponding to FIGS. 2(*a*) to 2(*b*) but for a third embodiment.
Figure 4B:
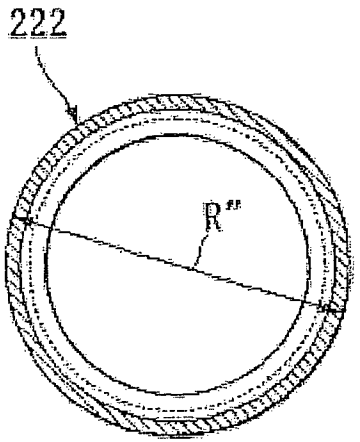
Figure 4A:
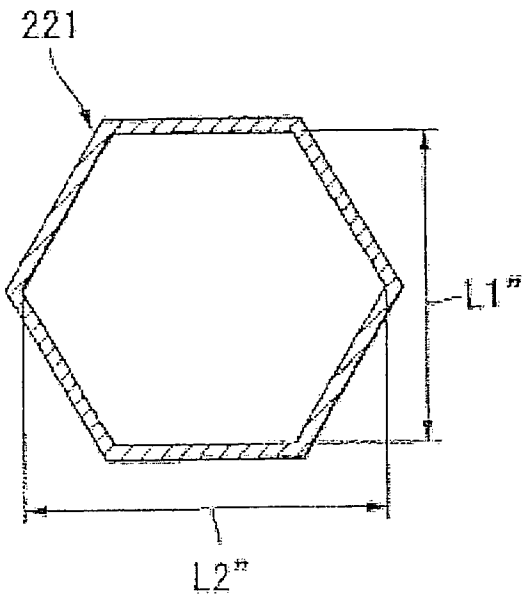

Hereinbelow, descriptions will be given as to embodiments of the present invention with reference to drawings. It should be noted that the up and the down directions in FIGS. 1 to 4 are expressed as the up and the down directions in the following descriptions. The left and the right directions in FIG. 1 are respectively expressed as the frontward and the rearward directions in the following descriptions, while the right and the left directions in FIGS. 2 to 4 are expressed also as the right and the left directions in the following descriptions.

Embodiment 1

FIG. 1 shows a muffler (silencer) 10 provided in a position at the downstream side of the exhaust system to lead the exhaust gas from the engine (internal combustion engine) to the outside of the engine, which is a motor of, for example, a saddle-ride type vehicle. The muffler 10 has a cylindrical appearance substantially along the front-to-rear direction. Formed in the front-end portion of the muffler 10 is a connect portion 14*a* to which an exhaust pipe extending from the exhaust port of the engine is connected. Meanwhile, formed in the rear-end portion of the muffler 10 is an exhaust-gas outlet (not illustrated) though which the exhaust gas is emitted to the air.

A front cap 12 and an end cap 13 are respectively attached to the front- and the rear-end portions of a cylindrical jacket 11 of the muffler 10. In the following descriptions, the center axis line of the muffler 10 (jacket 11) is referred to as a muffler axis line C.

The front cap 12 has a funnel shape with its diameter getting smaller towards the front side (upstream side) thereof. An exhaust inlet pipe 14 penetrates, and is supported by an opening at the front end of the front cap 12. The above-mentioned connecting portion 14*a* is formed in the front-end portion of the exhaust inlet pipe 14. The end cap 13, on the other hand, has a disc shape that is substantially coaxial with the jacket 11, and has the above-mentioned exhaust-gas outlet formed in the rear end portion thereof.

Inside the jacket 11, a plurality of partition walls 15*a*, 15*b* and 15*c*, each of which has a disc shape being substantially coaxial with the jacket 11, are formed to separate the space inside the jacket 11 into a plurality of expansion chambers 16*a*, 16*b*, 16*c* and 16*d*. A plurality of communication pipes 17*a*, 17*b* and 17*c* penetrate and are supported by the partition walls, as necessary, to communicate between the expansion chambers. The exhaust gas introduced into the muffler 10 from the exhaust-gas inlet pipe 14, and passes through each expansion chamber as reversing its flowing direction inside the jacket 11. The exhaust gas is cooled and its pressure is decreased to reduce the exhaust heat and the exhaust noise during the process, and then the exhaust gas is discharged to the air through the exhaust-gas outlet.

A mounting member 18 is provided on the upper part of the outer circumference at the middle portion in the front-to-rear direction of the jacket 11. The mounting member 18 is used for attaching the portion of the jacket 11 to a body frame F of the vehicle. The mounting member 18 is composed of a patch 18*a* and a stay 18*b*. The stay 18*b*, with a chevron shape when viewed from a side, protrudes upward from the patch 18*a*, which has a curved plate shape such as to fit the upper outer circumference of the jacket 11. The patch 18*a* is attached to the upper part of the outer circumference of the jacket 11 by welding or the like. Specifically, the patch 18*a* is attached on the outer circumferential side of a portion where the foremost partition wall 15*a* is formed. Stay 18*b*, on the other hand, is attached to the body frame F with a bolt and the like (see, FIG. 2(*c*)).

The jacket 11 has a double-tube structure including an outer tube 21 that forms the outer circumferential surface of the jacket 11, and an inner tube 22 that is placed inside the outer tube 21 with a certain gap in between.

The outer and the inner tubes 21 and 22 are formed of, for example, a steel plate of the same kind into cylindrical shapes. The outer tube 21 has a substantially constant cross-sectional shape from the front end and to the rear end. On the other hand, the inner tube 22 has a substantially constant cross-sectional shape except for the front- and rear-end portions thereof. An annular step portion 23 is formed at each of the front- and the rear-end portions of the inner tube 22. Each step portion 23 has a cross-sectional shape with a larger diameter than that of the cross-sectional shape of the section between the front- and the rear-end portions (principal section). The outer circumferences of the front and the rear step portions 23 are brought into contact, from inside, with the inner circumferences of the front- and the rear-end portions of the outer tube 21, respectively. Thus, the outer tube 21 supports the inner tube 22. It should be noted that the inner tube 22 may have another step portion such as the ones described above formed in the middle portion in the front-to-rear direction.

The principal section of the inner tube 22 has a substantially constant cross-sectional shape, while an annular space K is formed in a substantially constant thickness between the outer circumferential surface of the principal section and the inner circumferential surface of the outer tube 21. The annular space K has either a hollow structure or a structure filled with a vibration-deadening material and a sound-absorbing material to suppress the transmission of heat and sound energy of the exhaust gas inside the jacket 11.

Now, descriptions will be given also with reference to FIGS. 2(*a*) to 2(*c*). While the cross-sectional shapes of the principal section and of the front and the rear step portions 23 of the inner tube 22 are substantially perfect-circle shapes, the outer tube 21 has an ellipsoid shape with its vertical diameter being a little longer than the horizontal diameter.

In more detail, as FIGS. 2(*a*) and 2(*b*) show, the cross-sectional shape of each of the principal section and of the front and the rear step portions 23 of the inner tube 22 is a substantially perfect-circle shape before the inner tube 22 is assembled with the outer tube 21 (in a separated state). On the other hand, the cross-sectional shape of the outer tube 21 is an ellipsoidal shape with a longer vertical diameter before the outer tube 21 is assembled with the inner tube 22 (in a separated state). FIG. 2(*c*) shows a state in which the outer and the inner tubes 21 and 22 are assembled together. In FIG. 2(*c*), the cross-sectional shapes of the principal section and of the front and the rear step portions 23 of the inner tube 22 are perfectly circular shapes as described above, while the cross-sectional shape of the outer tube 21 is an ellipsoidal shape as described above. The following fact should be noted here. While the cross-sectional shape of the inner tube 22 changes very little before and after the assembling, the cross-sectional shape of the outer tube 21 after the assembling is an ellipsoidal shape that is a little narrower in the vertical direction and a little wider in the horizontal direction in comparison to the state before the assembling. In other words, the outer tube 21 is assembled with the inner tube 22 into a single body by changing the cross-sectional shape of the outer tube 21 to fit the cross-sectional shape of the inner tube 22.

FIGS. 2(*a*) and 2(*b*) show the cross sections of the outer and the inner tubes 21 and 22, respectively, while the cross sections correspond to the portion where any of the front and rear step portions 23 of the inner tube 22 is located. A shorter diameter L1 (the length of the minor axis, or the distance between the right and the left ends) in the cross-sectional shape of the inner circumference of the outer tube 21 is made shorter than a diameter R in the cross-sectional shape of the outer circumference of the inner tube 22 (of the step portions 23). A longer diameter L2 (the length of the major axis, or the distance between the upper and the lower ends) in the cross-sectional shape of the inner circumference of the outer tube 21 is made longer than the diameter R of the inner tube 22. In addition, the perimeter of the inner circumference in the cross-sectional shape of the outer tube 21 is made longer than the perimeter of the outer circumference in the cross-sectional shape of the inner tube 22 (of the step portions 23). It should be noted that the thicknesses of the outer and the inner tubes 21 and 22 are respectively formed in uniform wall-thicknesses (thicknesses of the plate) in this embodiment, but that each wall-thickness may vary from portion to portion as appropriately.

With this structure, when the inner tube 22 is inserted into the outer tube 21, the inner tube 22 that is relatively rigid thanks to the front and the rear step portions 23 formed therein does not deform, but the outer tube 21 elastically deforms as expanding the horizontal width and diminishing the vertical width. In addition, the inner circumferential surfaces of the front- and rear-end portions of the outer tube 21 substantially match to the outer circumferential surfaces of the front and the rear step portions 23 of the inner tube 22. When the outer tube 21 elastically deforms, a right and a left portions of the inner circumferential surface of each of the front- and the rear-end portions of the outer tube 21 are respectively brought into close contact with a right and a left portions of the outer circumferential surface of each of the front and the rear step portions 23 of the inner tube 22. At this time, the upper and the lower portions of the inner circumferential surface of the front- and the rear-end portions of the outer tube 21 pull away from the upper and the lower portions of the outer circumferential surface of each of the front and the rear step portions 23 of the inner tube 22. A certain gap S is thus formed.

In other words, the outer tube 21 supports the inner tube 22, partially and elastically. Specifically, with the right and the left portions (contact portions 23*a*) of each of the front- and the rear-end portions of the outer tube 21 grip the front and the rear step portions 23 of the inner tube 22 from the two sides in the right and left direction of the step portions 23. In addition, the gap S is formed between the inner tube 22 and each of the upper and the lower portions (non-contact portions 23*b*) of each of the front- and the rear-end portions of the outer tube 21. Accordingly, the outer tube 21 can elastically deform as being favorable to an increase in the horizontal width of the outer tube 21. In addition, the inner tube 22 can be inserted into the outer tube 21 with more ease.

The right and the left contact portions 23*a* of the rear step portion 23 of the inner tube 22 are fixed to the right and the left contact portions 23*a* of the rear-end portion of the outer tube 21 by welding or the like. On the other hand, the right and the left portions of the front step portion 23 of the inner tube 22 are elastically held and supported by the right and the left contact portions 23*a* of the front-end portion of the outer tube 21, as described before. Accordingly, the outer and the inner tubes 21 and 22 can be displaced relatively to each other in the direction of the muffler axis line C. With this configuration, even when there is a difference in thermal expansion along the direction of the muffler axis line C between the outer and the inner tubes 21 and 22, the difference can be absorbed. Additionally, the vibration of the inner tube 22 with respect to the outer tube 21 can be suppressed. It should be noted that the front-end portions of the outer and of the inner tubes 21 and 22 may be fixed to each other while the rear-end portions can be displaced relatively from each other.

As the cross section in FIG. 2(*c*) shows that the mounting portion 18 to the body frame F is provided on the outer circumferential surface side of the upper-side non-contact portion 23*b* of the outer tube 21. In addition, in the front-end portion or in the rear-end portion of the outer tube 21, the right and left contact portions 23*a* and the upper and the lower non-contact portions 23*b* are adjacent to each other in the circumferential direction of the outer tube 21. In other words, the mounting portion 18 is provided on the outer circumferential side of the outer tube 21 between the two adjacent right and the left contacting portions 23*a* that are arranged at the two sides of the upper-side non-contacting portion 23*b*.

The front-end portion (exhaust-gas inlet pipe 14) of the muffler 10 is supported by the exhaust pipe, and, at the same time, the upper-side middle portion in the front-to-rear direction is supported (suspended) by the body frame F using the mounting portion 18. At this time, the weight of the muffler 10 itself acts on the mounting position 18, and thus the upper portion of the outer tube 21 is relatively pulled upward with the mounting portion 18. Accordingly, the outer tube 21 stretches in the vertical direction, while the outer tube 21 contracts in the horizontal direction. As a result the right and the left contact portions 23*a* approaches each other, and thus the force to grip the inner tube 22, that is, the tensile force acting on the inner tube 22 is strengthened.

As has been described thus far, the muffler structure of the above embodiment is a double-pipe structure including the outer and the inner tubes 21 and 22. The inner tube 22 has the front and the rear annular step portions 23 which are brought into contact with the outer tube 21 from inside, and which are thus supported by the outer tube 21. The outer tube 21 is, partially and elastically, brought into close contact with, and thus supports the front and the rear step portions 23.

With this conFIGuration, the outer tube 21 is partially and elastically brought into close contact with the inner tube 22, which has a relatively high rigidity because the inner tube 22 has the annular step portions 23 in the front and the rear portions thereof. Accordingly, the inner tube 22 can be supported with the tensile force (elastic resilience) of the outer tube 21. Thus, even with a difference in thermal expansion between the inner tube 22 and the outer tube 21, no such gap will be formed between the step portion 23 and the outer tube 21 as the one formed all along the circumference, or no such thing will take place as a positional change of the gap between the step portion 23 and the outer tube 21. As a result, generation of abnormal noise can be suppressed. It should be noted that, also with another configuration such that the inner tube 22 with an ellipsoidal cross-sectional shape is inserted into the outer tube 21 with a perfectly circular cross-sectional shape, a similar effect can be obtained.

In addition, also in a case where a vibration-deadening material and a sound-absorbing material such as glass wool and elastic body are inserted into the interstice between the outer and the inner tubes 21 and 22, the operation can be performed by elastically deforming the outer tube 21 using the inner tube 22. Accordingly, the vibration-deadening material and the like can be inserted into the interstice with ease. In addition, once the vibration-deadening material and the like is successfully inserted, the material and the like can be pressed by and held securely with the elastic force of the outer tube 21.

Moreover, both of the displacement of the inner tube 22 and the generation of hammering sound can be prevented without providing any other means for holding the inner tube 22 between the outer and the inner tubes 21 and 22. Accordingly, reduction of the number of parts can be expected, and thus the costs can be reduced.

Furthermore, in the above-described muffler structure, the outer tube 21 supports each of the front and the rear step portions 23, at two points, that is, the right contact portion 23*a* and the left contact portion 23*a*. Accordingly, the outer tube 21 can securely support the front and the rear step portions 23 by gripping the front and the rear step portions 23 from the right and the left directions using the tensile force of the outer tube 21.

Still furthermore, the outer tube 21 deforms so that the distance between the right and the left contact portions 23*a* can be widened. Accordingly, the operation of inserting the inner tube 22 into the outer tube 21 can be made easy in comparison to a case where the more rigid inner tube 22 has to be deformed. The operation can be made easy also in comparison to a case where the inner tube 22 has to press fit the outer tube 21 for inserting the inner tube 22 into the outer tube 21 without creating any gap in between. As a result, the assembling process of the muffler can be simplified, and thus the costs can be reduced.

Even still furthermore, since the outer tube 21 can be deformed with ease, no excessive tensile force acts on the inner tube 22. When the muffler 10 in a hot state is rapidly cooled, the difference in thermal contraction in the direction of the muffler axis line C between the outer and the inner tubes 21 and 22 may probably cause abnormal noise (rasping noise) to be generated. With the easy deformability of the outer tube 21, even in the case of rapid cooling, the generation of abnormal noise can be suppressed.

Even still furthermore, in the above-described muffler structure, the outer tube 21 includes the mounting member 18 for attaching the muffler 10 to the body frame F, while the mounting member 18 is placed in a position between the two adjacent ones of the contact portions 23*a*. Accordingly, when the muffler 10 is attached to the body frame F, the weight of the muffler 10 acts on the muffler 10 itself to strengthen the tensile force applied by the adjacent contact portions 23*a* to the inner tube 22. Thus, the inner tube 22 can be supported more securely.

Embodiment 2

Next, descriptions of a second embodiment of the present invention will be given with reference to FIGS. 3(*a*) to 3(*c*).

A muffler 110 in this embodiment differs from the muffler 10 in the first embodiment as the muffler 110 has a jacket 111 with a different cross-sectional shape. Note that identical portions to those in the first embodiment will be given the same reference numerals and that the description thereof will be omitted.

The jacket 111 has a double-pipe structure including an outer and an inner tubes 121 and 122, each of which has a cross-sectional shape of, for example, a trapezoid lying sideways with the two parallel sides being on the right and the left sides. In the cross-sectional shape of the jacket 111 (the outer and the inner tube 121 and 122), each side curves as being convex outwards while each apex is chamfered into a circular-arc shape also as being convex outwards.

The outer and the inner tubes 121 and 122 are formed of a steel plate of the same kind into the above-mentioned cross-sectional shapes. The outer tube 121 has a substantially constant cross-sectional shape from the front end and to the rear end. On the other hand, the inner tube 122 has a substantially constant cross-sectional shape except for the front- and rear-end portions thereof. A step portion 123 is formed at each of the front- and the rear-end portions of the inner tube 122. Each step portion 123 has an expanded homothetic cross-sectional shape to the cross-sectional shape of the section between the front- and the rear-end portions (principal section). The outer circumferences of the front and the rear step portions 123 are brought into contact, from inside, with the inner circumferences of the front- and the rear-end portions of the outer tube 121, respectively. Thus, the outer tube 121 supports the inner tube 122. The principal section of the inner tube 122 has a substantially constant cross-sectional shape, while an annular space is formed in a substantially constant thickness between the outer circumferential surface of the principal section and the inner circumferential surface of the outer tube 121.

As FIGS. 3(*a*) and 3(*b*) show, the cross-sectional shape of each of the principal section and of the front and the rear step portions 123 of the inner tube 122, as well as of the outer tube 121 is the above-described trapezoidal shape before the inner tube 122 is assembled with the outer tube 123. FIG. 3(*c*) shows a state in which the outer and the inner tubes 121 and 122 are assembled together. In FIG. 3(*c*), the cross-sectional shapes of the principal section and of the front and the rear step portions 123 of the inner tube 122, as well as of the outer tube 121 are the above-described trapezoidal shapes. The following fact should be noted here. While the cross-sectional shape of the inner tube 122 changes very little before and after the assembling, the cross-sectional shape of the outer tube 121 after the assembling is a trapezoidal shape that is a little narrower in the vertical direction and a little wider in the horizontal direction in comparison to the state before the assembling. In other words, the outer tube 121 is assembled with the inner tube 122 into a single body by changing the cross-sectional shape of the outer tube 121 to fit the cross-sectional shape of the inner tube 122.

FIGS. 3(*a*) and 3(*b*) show the cross sections of the outer and the inner tubes 121 and 122, respectively, while the cross sections correspond to the portion where any of the front and the rear step portions 123 of the inner tube 122 is located. A horizontal width H1 in the cross-sectional shape of the inner circumference of the outer tube 121 is made narrower than a horizontal width H2 in the cross-sectional shape of the outer circumference of the inner tube 122 (of the step portions 123). A vertical width H3 in the cross-sectional shape of the inner circumference of the outer tube 121 is made wider than a vertical width H4 in the cross-sectional shape of the outer circumference of the inner tube 122 (of the step portions 123). In addition, the perimeter of the inner circumference in the cross-sectional shape of the outer tube 121 is made longer than the perimeter of the outer circumference in the cross-sectional shape of the inner tube 122 (of the step portions 123).

With this structure, when the inner tube 122 is inserted into the outer tube 121, the relatively rigid inner tube 122 does not deform, but the outer tube 121 elastically deforms as expanding the horizontal width and diminishing the vertical width. Then, a right and a left portions of the inner circumferential surface of each of the front- and the rear-end portions of the outer tube 121 are respectively brought into close contact with a right and a left portions of the outer circumferential surface of each of the front and the rear step portions 123 of the inner tube 122. At this time, the upper and the lower portions of the inner circumferential surface of the front- and the rear-end portions of the outer tube 121 pull away from the upper and the lower portions of the outer circumferential surface of each of the front and the rear step portions 123 of the inner tube 122. A certain gap S' is thus formed.

In other words, the outer tube 121 supports the inner tube 122, partially and elastically. Specifically, the right and the left portions (contact portions 123*a*) of each of the front- and the rear-end portions of the outer tube 121 grip the front and the rear step portions 123 of the inner tube 122 from the two sides in the right and left direction of the step portions 123. In addition, the gap S' is formed between the inner tube 122 and each of the upper and the lower portions (non-contact portions 123*b*) of each of the front- and the rear-end portions of the outer tube 121.

The right and the left portions of the rear step portion 123 of the inner tube 122 are fixed to the right and the left contact portions 123*a* of the rear-end portion of the outer tube 121 by welding or the like. On the other hand, the right and the left portions of the front step portion 123 of the inner tube 122 are elastically held and supported by the right and the left contact portions 123*a* of the front-end portion of the outer tube 121, as described before. Accordingly, the outer and the inner tubes 121 and 122 can be displaced relatively to each other in the direction of a muffler axis line C. Even when there is a difference in thermal expansion along the direction of the muffler axis line C between the outer and the inner tubes 121 and 122, the difference can be absorbed.

As has been described thus far, also in the muffler structure of the second embodiment, the outer tube 121 is, partially and elastically, brought into close contact with, and thus supports the front and the rear step portions 123. Accordingly, as in the case of the first embodiment, the inner tube 122 can be supported with the tensile force (elastic resilience) of the outer tube 121. Thus, even with a difference in thermal expansion between the inner tube 122 and the outer tube 121, generation of abnormal noise can be suppressed. In brief, the same effects as those in the first embodiment can be obtained regardless of the cross-sectional shapes of the outer and the inner tubes 121 and 122.

In addition, suppose that a mounting member 18 for attaching the muffler 110 to a body frame F is provided in a position between the two adjacent ones of the contact portions 123*a* of the outer tube 121. Accordingly, as in the case of the first embodiment, when the muffler 110 is attached to the body frame F, the weight of the muffler 110 acts on the muffler 110 itself to strengthen the tensile force applied by the outer tube 121. Thus, the inner tube 122 can be supported more securely.

Embodiment 3

Next, descriptions of a third embodiment of the present invention will be given with reference to FIGS. 4(*a*) to 4(*c*).

A muffler 210 in this embodiment differs from the muffler 10 in the first embodiment as the muffler 210 has a jacket 211 with a double-pipe structure in which an outer and an inner tubes 221 and 222 with the following cross-sectional shapes are combined together. The outer tube 221 has a polygonal cross-sectional shape (for example, a substantially equilateral hexagon), while the inner tube 222 has a circular cross-sectional shape (for example, a perfect circle). Note that identical portions to those in the first embodiment will be given the same reference numerals and that the description thereof will be omitted.

The outer and the inner tubes 221 and 222 are formed of, for example, a steel plate of the same kind into the above-mentioned cross-sectional shapes. The outer tube 221 has a substantially constant cross-sectional shape from the front end and to the rear end. On the other hand, the inner tube 222 has a substantially constant cross-sectional shape except for the front- and rear-end portions thereof. A step portion 223 is formed at each of the front- and the rear-end portions of the inner tube 222. Each step portion 223 has a cross-sectional shape with a larger diameter than that of the cross-sectional shape of the section between the front- and the rear-end portions (principal section). The outer circumferences of the front and the rear step portions 223 are brought into contact, from inside, with the inner circumferences of the front- and the rear-end portions of the outer tube 221, respectively. Thus, the outer tube 221 supports the inner tube 222. The principal section of the inner tube 222 has a substantially constant cross-sectional shape, while an annular space is formed between the outer circumferential surface of the principal section and the inner circumferential surface of the outer tube 221. Here, the thickness of the annular space varies from portion to portion.

As FIGS. 4(*a*) and 4(*b*) show, the cross-sectional shape of each of the principal section, as well as of the front and the rear step portions 223 of the inner tube 222 is a substantially perfect-circle shape before the inner tube 222 is assembled with the outer tube 221. Meanwhile, the cross-sectional shape of the outer tube 221 is a substantially equilateral-hexagon shape before the outer tube 221 is assembled with the inner tube 222. FIG. 4(*c*) shows a state in which the outer and the inner tubes 221 and 222 are assembled together. In FIG. 4(*c*), the cross-sectional shapes of the principal section, as well as of the front and the rear step portions 223 of the inner tube 222 are the perfectly circular shape, while the cross-sectional shape of the outer tube 221 is the above-described polygonal shape. The following fact should be noted here. While the cross-sectional shape of the inner tube 222 changes very little before and after the assembling, the cross-sectional shape of the outer tube 221 after the assembling is a polygonal shape that has a little narrower width between apexes and a little wider width between opposite sides in comparison to the state before the assembling. In other words, the outer tube 221 is assembled with the inner tube 222 into a single body by changing the cross-sectional shape of the outer tube 221 to fit the cross-sectional shape of the inner tube 222.

FIGS. 4(*a*) and 4B show the cross sections of the outer and the inner tubes 221 and 222, respectively, while the cross sections correspond to the portion where any of the front and the rear step portions 223 of the inner tube 222 is located. The distance between two opposite sides L1" in the cross-sectional shape of the inner circumference of the outer tube 221 is made shorter than a diameter R" in the cross-sectional shape of the outer circumference of the inner tube 222 (of the step portions 223). The distance between two opposite apexes L2" in the cross-sectional shape of the inner circumference of the outer tube 221 is made longer than the diameter R" in the cross-sectional shape of the outer circumference of the inner tube 222 (of the step portions 223). In addition, the perimeter of the inner circumference in the cross-sectional shape of the outer tube 221 is made longer than the perimeter of the outer circumference in the cross-sectional shape of the inner tube 222 (of the step portions 223).

With this structure, when the inner tube 222 is inserted into the outer tube 221, the relatively rigid inner tube 222 does not deform, but the outer tube 221 elastically deforms as expanding the distance between two sides and diminishing the distance between apexes. Then, the inner circumferential surface of the portions (contact portions 223*a*), which portions correspond to the above-mentioned sides, of each of the front- and the rear-end portions of the outer tube 221 are respectively brought into close contact with the outer circumferential surface of each of the front and the rear step portions 223 of the inner tube 222. At this time, the inner circumferential surface of the portions (non-contact portions 223*b*), which portions correspond to the above-mentioned apexes, of each of the front- and the rear-end portions of the outer tube 221 pull away from the outer circumferential surface of each of the front and the rear step portions 223 of the inner tube 222. A certain gap S" is thus formed.

In other words, the outer tube 221 supports the inner tube 222, partially and elastically. Specifically, the contact portions 223*a* of each of the front- and the rear-end portions of the outer tube 221 grip the front and the rear step portions 223 of the inner tube 222 from a plurality of directions. In addition, the gap S" is formed between the inner tube 222 and each of the non-contact portions 223*b* of each of the front- and the rear-end portions of the outer tube 221.

To each contact portion 223*a* of the rear-end portion of the outer tube 221, the corresponding portions of the rear step portion 223 of the inner tube 222 are fixed by welding or the like. On the other hand, the contact portions 223*a* of the front-end portion of the outer tube 221 elastically hold and support the corresponding portions of the front step portion 223 of the inner tube 222, as described before. Accordingly, the outer and the inner tubes 221 and 222 can be displaced relatively to each other in the direction of a muffler axis line C. Even when there is a difference in thermal expansion along the direction of the muffler axis line C between the outer and the inner tubes 221 and 222, the difference can be absorbed.

As has been described thus far, also in the muffler structure of the third embodiment, the outer tube 221 is, partially and elastically, brought into close contact with, and thus supports the front and the rear step portions 223. Accordingly, as in the case of the first and the second embodiments, the inner tube 222 can be supported with the tensile force (elastic resilience) of the outer tube 221. Thus, even with a difference in thermal expansion between the inner tube 222 and the outer tube 221, generation of abnormal noise can be suppressed. In brief, the same effects as those in the first and the second embodiments can be obtained even when the cross-sectional shape of the outer tube 221 differs from the cross-sectional shape of the inner tube 222. It should be noted that another configuration including the outer tube 221 with a circular cross-sectional shape and the inner tube 222 with a polygonal cross-sectional shape may be employed.

In addition, suppose that a mounting member 18 for attaching the muffler 210 to a body frame F is provided in a position between the two adjacent ones of the contact portions 223*a* of the outer tube 221. Accordingly, as in the cases of the first and the second embodiments, when the muffler 210 is attached to the body frame F, the weight of the muffler 210 acts on the muffler 210 itself to strengthen the tensile force applied by the outer tube 221. Thus, the inner tube 222 can be supported more securely.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A muffler structure being a double-pipe structure comprising:

an inner tube;

an outer tube; and an annular step portion which is formed in the inner tube, and which is brought into contact with an inside of the outer tube, so that the inner tube is supported by the outer tube, wherein the outer tube is brought into close contact with the step portion partially and elastically and supports the step portion, wherein the outer tube includes a mounting member for attaching the muffler to a designated frame, and the mounting member is provided in a position between two adjacent ones of two or more contact portions, wherein the cross-sectional shape of the outer tube is different from the cross-sectional shape of the step portion of the inner tube.

2. The muffler structure as recited in claim 1, wherein the outer tube supports the step portion at the two or more contact portions.

3. The muffler structure as recited in claim 1, wherein the outer tube and the inner tube are assembled together by deforming the cross-sectional shape of the outer tube to fit the cross-sectional shape of the step portion of the inner tube.

4. The muffler structure as recited in claim 2, wherein the outer tube and the inner tube are assembled together by deforming the cross-sectional shape of the outer tube to fit the cross-sectional shape of the step portion of the inner tube.

5. The muffler structure as recited in claim 1, wherein the cross-sectional shape of the outer tube is different from the cross-sectional shape of the step portion of the inner tube when the outer and the inner tubes are assembled together.

6. A muffler structure being a double-pipe structure comprising:

an inner tube;

an outer tube; and an annular step portion which is formed at one end of the inner tube, and which is brought into contact with an inside of the outer tube, so that the inner tube is supported by the outer tube, wherein the outer tube is brought into close contact with the step portion partially and elastically and supports the step portion, wherein the outer tube includes a mounting member for attaching the muffler to a designated frame, and the mounting member is provided in a position between two adjacent ones of two or more contact portions, wherein the cross-sectional shape of the outer tube is different from the cross-sectional shape of the step portion of the inner tube.

7. The muffler structure as recited in claim 6, wherein the outer tube supports the step portion at the two or more contact portions.

8. A muffler structure being a double-pipe structure comprising:

an inner tube;

an outer tube; and at least two annular step portions formed in the inner tube, and which are brought into contact with an inside of the outer tube, so that the inner tube is supported by the outer tube, wherein the outer tube is brought into close contact with the step portions partially and elastically and supports the step portions, wherein two of the step portions are disposed at opposite ends of the inner tube, and wherein the outer tube supports each of the step portions at two or more contact portions, wherein the outer tube includes a mounting member for attaching the muffler to a designated frame, and the mounting member is provided in a position between two adjacent ones of the contact portions, wherein the cross-sectional shape of the outer tube is different from the cross-sectional shape of the step portion of the inner tube.

* * * * *